US010253762B2

(12) United States Patent
Chu

(10) Patent No.: US 10,253,762 B2
(45) Date of Patent: Apr. 9, 2019

(54) EASILY ASSEMBLED INFLATOR

(75) Inventor: Keng-Fong Chu, New Taipei (TW)

(73) Assignee: Jiao Hsiung Industry Corp., Shulin Dist., New Taipei (TW)

( * ) Notice: Subject to any disclaimer, the term of this patent is extended or adjusted under 35 U.S.C. 154(b) by 967 days.

(21) Appl. No.: 13/612,955

(22) Filed: Sep. 13, 2012

(65) Prior Publication Data

US 2013/0189137 A1 Jul. 25, 2013

(30) Foreign Application Priority Data

Jan. 20, 2012 (TW) ..... 101201615 U

(51) Int. Cl.
*F04B 33/00* (2006.01)

(52) U.S. Cl.
CPC ..... *F04B 33/005* (2013.01)

(58) Field of Classification Search
CPC ..... F04B 33/055
USPC ..... 417/437, 555.1; 92/165 R, 169.1
See application file for complete search history.

(56) References Cited

U.S. PATENT DOCUMENTS 2,386,562 A * 10/1945 Mahoney ..... F16L 33/22 285/242
4,106,392 A * 8/1978 Johnson et al. ..... 92/128
4,783,897 A * 11/1988 Basnett ..... 92/161
5,316,350 A * 5/1994 Kollenbrandt et al. ..... 285/242
5,476,372 A * 12/1995 Yang ..... 417/553
6,017,196 A * 1/2000 Wu ..... 417/234

* cited by examiner

*Primary Examiner* — Dominick L Plakkoottam
*Assistant Examiner* — Stephen A Mick
(74) *Attorney, Agent, or Firm* — Charles E. Baxley

(57) ABSTRACT

An easily assembled inflator has a cylinder, a piston rod, a piston, an assembled seal cover and a sleeve. Because the assembled seal cover has at least two cover segments, the cover segments can be mounted around the piston rod by being connected together radially. Then the piston does not interfere with the cover segments and the sequence of the assembly of the piston and the assembled seal cover is not limited, as well. Thus, the assembly is more convenient and flexible. Besides, because the assembled seal cover has multiple cover segments, the whole assembled seal cover can bear more stress and has more room to be deformed. Then the assembled seal cover is not damaged and broken easily when pushed in to the cylinder. To sum up, the inflator as mentioned above is easy to be assembled and is not damaged easily during the assembly.

9 Claims, 6 Drawing Sheets

EASILY ASSEMBLED INFLATOR

BACKGROUND OF THE INVENTION

1. Field of the Invention

The present invention relates to an easily assembled inflator, especially to an easily assembled inflator that is easy to be assembled and is not damaged easily during the assembly.

2. Description of the Prior Arts

An inflator gives air into sealed objects, such as tires and balls. With reference to FIGS. 5 and 6, the conventional portable inflator has a cylinder 91, a piston rod 92, a piston 93, a seal cover 94 and a sleeve 95. The cylinder 91 has an inner space, an opening 911 end, a closed end, a valve 912 and multiple annular grooves 913. The valve 912 is mounted through the closed end. The annular grooves 913 are formed on an inside wall of the cylinder 91 and are formed adjacent to the opening 911. The piston rod 92 is mounted in the cylinder 91. The piston 93 is mounted on an end of the piston rod 92 and is mounted in the cylinder 91. The seal cover 94 is mounted around the piston rod 92 and is mounted to the edge around the opening 911 of the cylinder 91. The seal cover 94 has multiple side flanges 941 formed on an outside wall of the seal cover 94 and engaging with the annular grooves 913 of the cylinder 91. Thus, the seal cover 94 is mounted securely to the cylinder 91. The sleeve 95 is mounted around the edge around the opening 911 of the cylinder 91 and has a top flange 951. The top flange 951 is formed annularly around an inside face of the sleeve 95 and adjacent to a top of the sleeve 95. The top flange 951 is clamped between the edge around the opening 911 and the seal cover 94 to fill up a gap between the cylinder 91 and the seal cover 94. Therefore, the cylinder 91, the piston rod 92, the seal cover 94 and the sleeve 95 are mounted securely and tightly.

However, the sequence of the assembly of the inflator is limited. For example, because the seal cover 94 is moved axially to mount around the piston rod 92 and an outer diameter of the seal cover 94 is bigger than an inner diameter of the piston 93, the seal cover 94 must be mounted on the piston rod 92 before the piston 93 is mounted on the piston rod 92, which causes inconvenience in the assembly. Besides, an outer diameter of the side flange 941 of the seal cover 94 is bigger than an inner diameter of the opening 911 of the cylinder 91. Then the seal cover 94 must be pushed greatly so that the side flanges 941 may deformed and the seal cover 94 is inserted into the cylinder 91. Nevertheless, the seal cover 94 is damaged and broken easily when being pushed. Thus, the high defect rate during production causes the manufacture of the inflator to not be sufficiently profitable.

To overcome the shortcomings, the present invention provides an easily assembled inflator to mitigate or obviate the aforementioned problems.

SUMMARY OF THE INVENTION

The main objective of the present invention is to provide an easily assembled inflator that is easy to be assembled and is not damaged easily during the assembly.

The easily assembled inflator in accordance with the present invention has a cylinder, a piston rod, a piston, an assembled seal cover and a sleeve. Because the assembled seal cover has at least two cover segments, the cover segments can be mounted around the piston rod by being connected together radially. Then the piston does not interfere with the cover segments and the sequence of the assembly of the piston and the assembled seal cover is not limited, as well. Thus, the assembly is more convenient and flexible. Besides, in the same way, because the assembled seal cover has multiple cover segments, the whole assembled seal cover can bear more stress and has more room to be deformed in comparison to the conventional integrated seal cover. Then the assembled seal cover is not damaged and broken easily when pushed in to the cylinder. To sum up, the inflator as mentioned above is easy to be assembled and is not damaged easily during the assembly.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
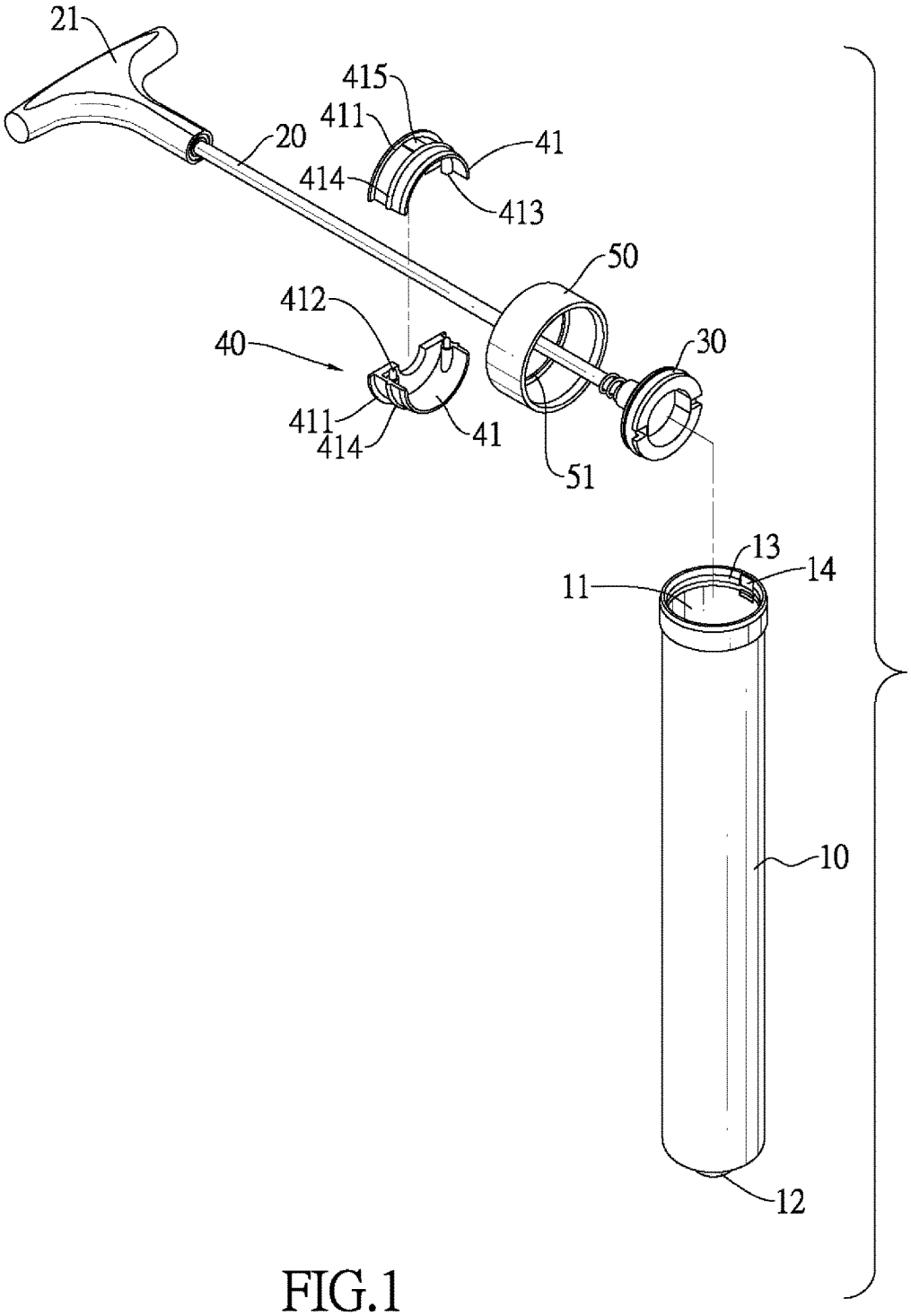
FIG. 1 is an exploded perspective view of a first embodiment of an easily assembled inflator in accordance with the present invention.
Figure 2:
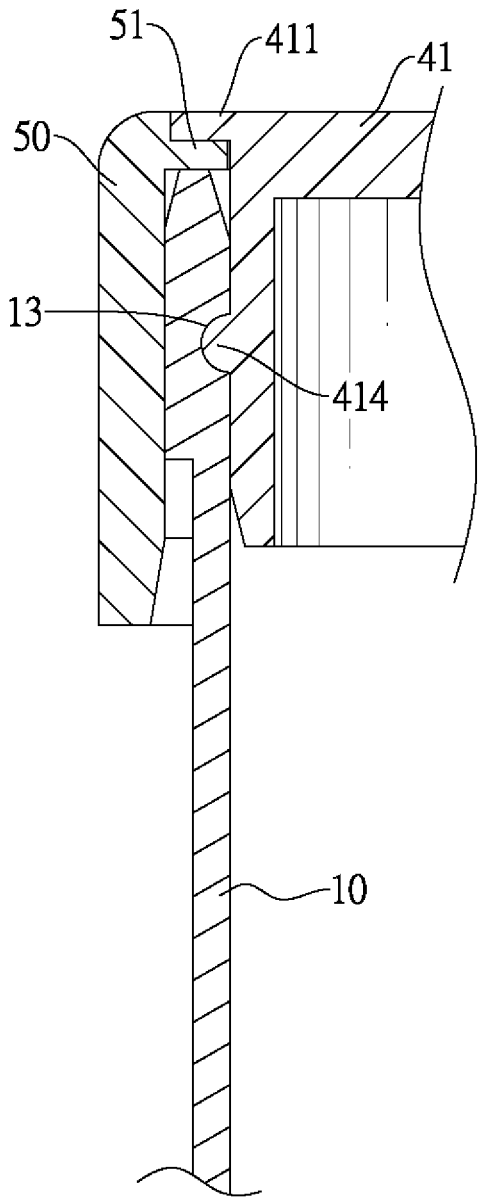
FIG. 2 is a partially side view in partial section of the easily assembled inflator in FIG. 1.

With reference to FIGS. 1 and 2, an easily assembled inflator in accordance with the present invention comprises a cylinder 10, a piston rod 20, a piston 30, an assembled seal cover 40 and a sleeve 50.

The cylinder 10 has an inner space, an opening end, a closed end and a valve 12. The opening end has an opening 11. The valve 12 is mounted through the closed end. In a preferred embodiment, the cylinder 10 has an annular groove 13 and a cylinder recess 14. The annular groove 13 and the cylinder recess 14 are formed on an inside wall of the cylinder 10 and are formed adjacent to the opening 11. The cylinder recess 14 is nearer to the opening 11 than the annular groove 13.

The piston rod 20 is mounted in the cylinder 10 and has a first end, a second end and a holder 21. The holder 21 is mounted on the first end.

The piston 30 is mounted on the second end of the piston rod 20 and is mounted in the cylinder 10.

The assembled seal cover 40 is mounted around the piston rod 20 and has a set of cover segments 41. Each cover segment 41 has a cover top flange 411. The cover top flange 411 is formed around an outside wall of the cover segment 41, is formed adjacent to a top of the cover segment 41 and corresponds to the opening 11 of the cylinder 10. In a preferred embodiment, the assembled seal cover 40 has two cover segments 41. One of the cover segments 41 has two mounting pins 412 formed on a side surface of the cover segment 41, the other cover segment 41 has two mounting recesses 413 formed on a side surface of the cover segment 41. The two cover segments 41 are connected together and are mounted around the piston rod 20 by inserting the mounting pins 412 into the mounting recess 413 tightly. Each cover segment 41 has a cover side flange 414. The cover side flange 414 is formed on an outside wall of the cover segment 41 and engages with the annular groove 13 of the cylinder 10 to make the assembled seal cover 40 engage with the cylinder 10. One of the cover segments 41 further has a cover protrusion 415. The cover protrusion 415 is formed on the outside wall of the cover segment 41 and engages with the cylinder recess 14 of the cylinder 10.

The sleeve 50 is mounted around the opening 11 of the cylinder 10 and has a sleeve top flange 51. The sleeve top flange 51 is formed around an inside wall of the sleeve 50, is formed adjacent to a top of the sleeve 50 and corresponds to the cover top flanges 411 of the assembled seal cover 40. The cover segments 41 and the sleeve 50 are separate components. The cover segments 41 and the sleeve 50 transversely clamp the cylinder 10. In a preferred embodiment, the sleeve top flange 51 is clamped between the edge of the opening 11 of the cylinder 10 and the cover top flanges 411 of the assembled seal cover 40.

Because the sleeve top flange 51 of the sleeve 50 is clamped between the cylinder 10 and the assembled seal cover 40 and the assembled seal cover 40 engages with the cylinder 10 by the cover side flange 414 engaging with the annular groove 13, the assembled seal cover 40 with the sleeve 50 is mounted securely to the cylinder 10. Besides, the cover protrusion 415 of the cover segment 41 engages with the cylinder recess 14 of the cylinder 10 to keep the assembled seal cover 40 from being rotated relative to the cylinder 10, which eliminates any possible misunderstanding about that the inflator is defective.

Because the assembled seal cover 40 has at least two cover segments 41, the cover segments 41 can be mounted around the piston rod 20 by being connected together radially. Then the piston 30 does not interfere with the cover segments 41 and the sequence of the assembly of the piston 30, the holder 21 and the assembled seal cover 40 is not limited, as well. Thus, the assembly is more convenient and flexible. Besides, in the same way, because the assembled seal cover 40 has multiple cover segments 41, the whole assembled seal cover 40 can bear more stress and has more room to be deformed. Then the assembled seal cover 40 is not damaged and broken easily when pushed in to the cylinder 10. In conclusion, the inflator as mentioned above is easy to be assembled and is not damaged easily during the assembly.

Figure 3:
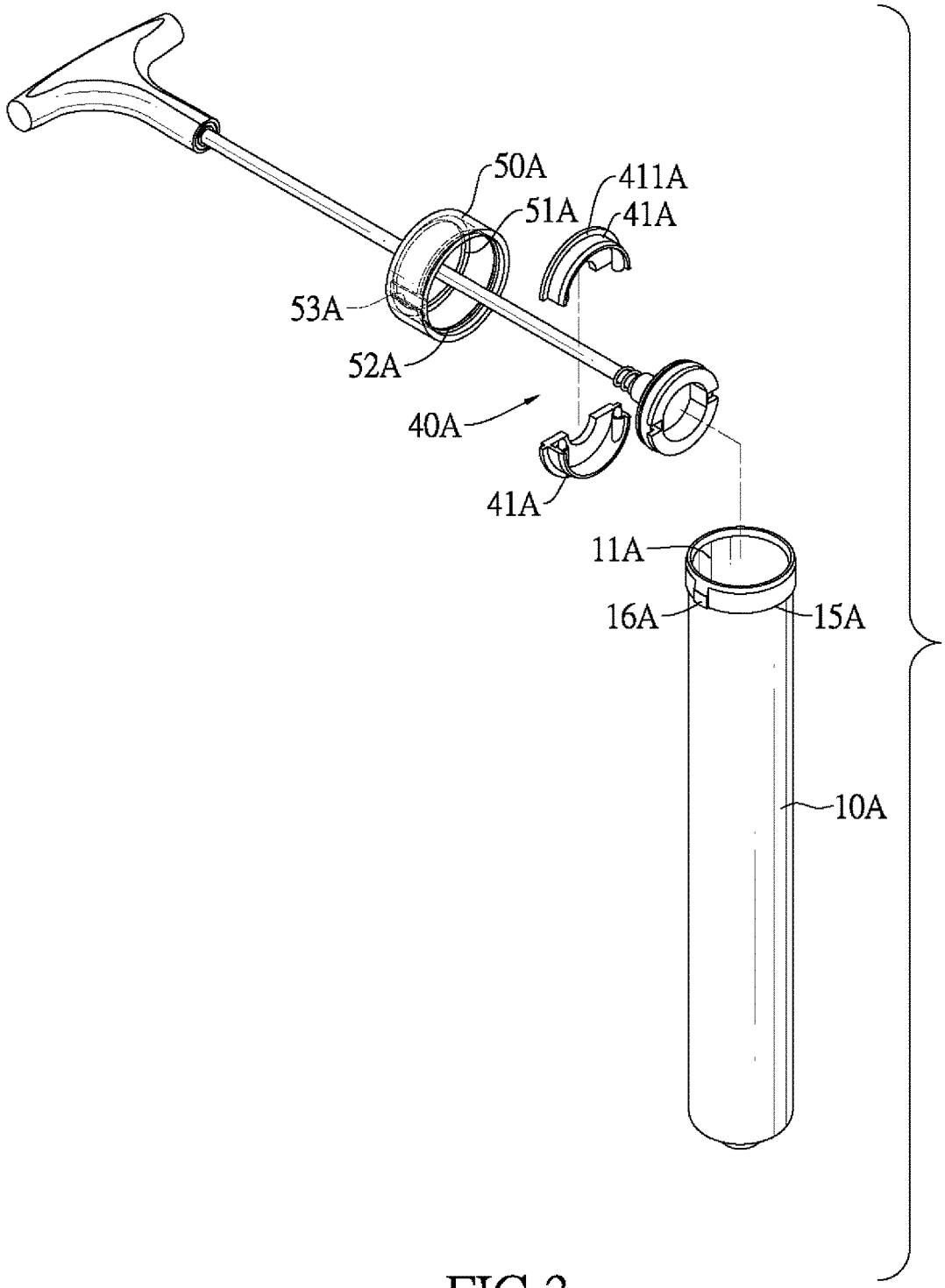
FIG. 3 is an exploded perspective view of a second embodiment of an easily assembled inflator in accordance with the present invention.
Figure 4:
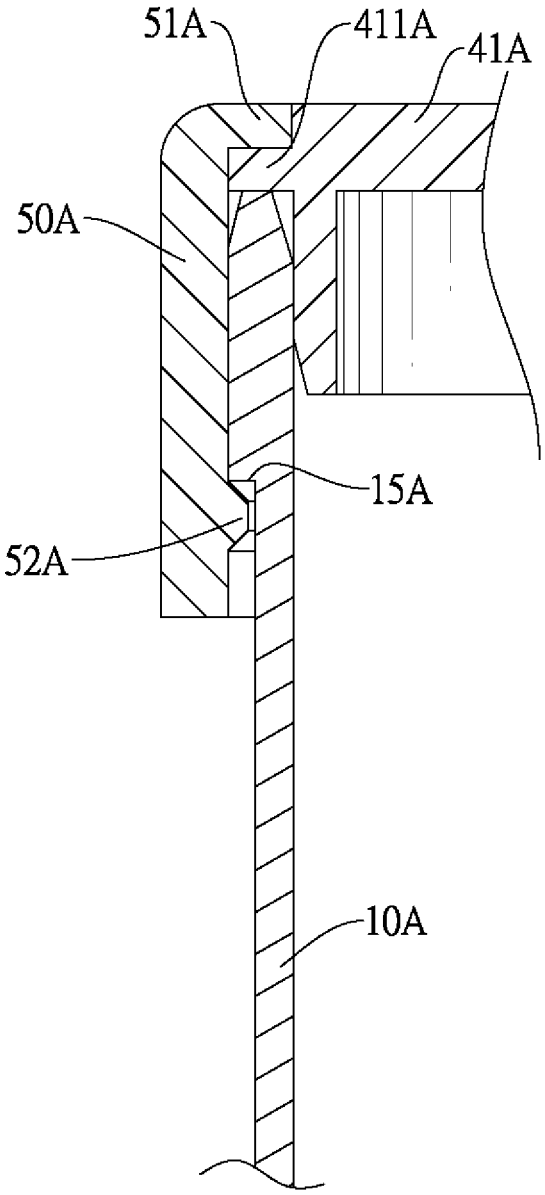
FIG. 4 is a partially side view in partial section of the easily assembled inflator in FIG. 3.
Figure 5:
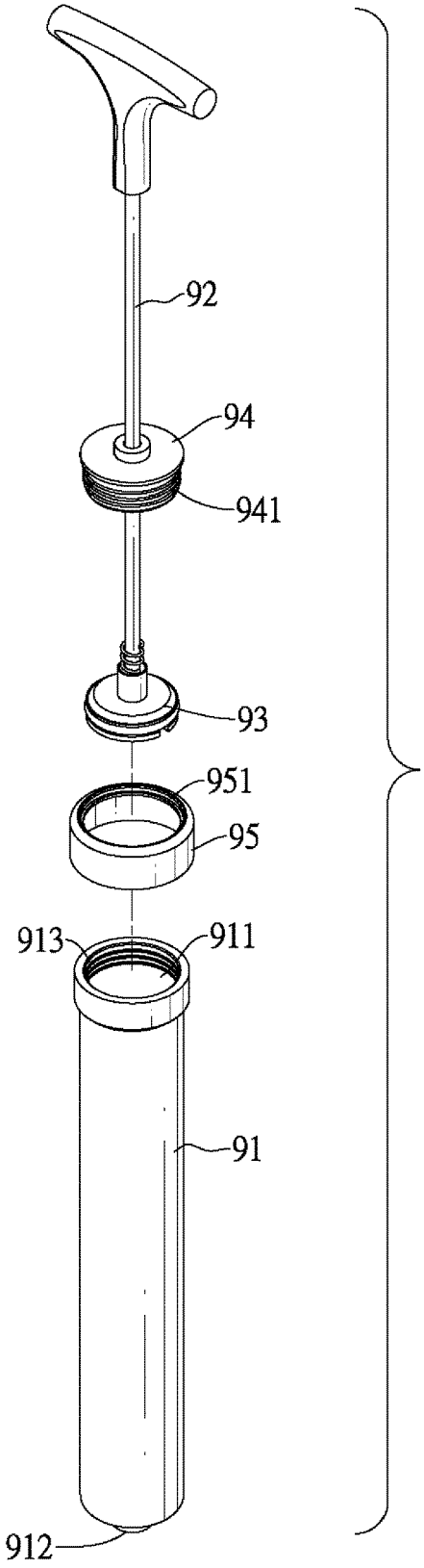
FIG.5 PRIOR ART
FIG. 5 is an exploded perspective view of a conventional inflator in accordance with the prior art.
Figure 6:
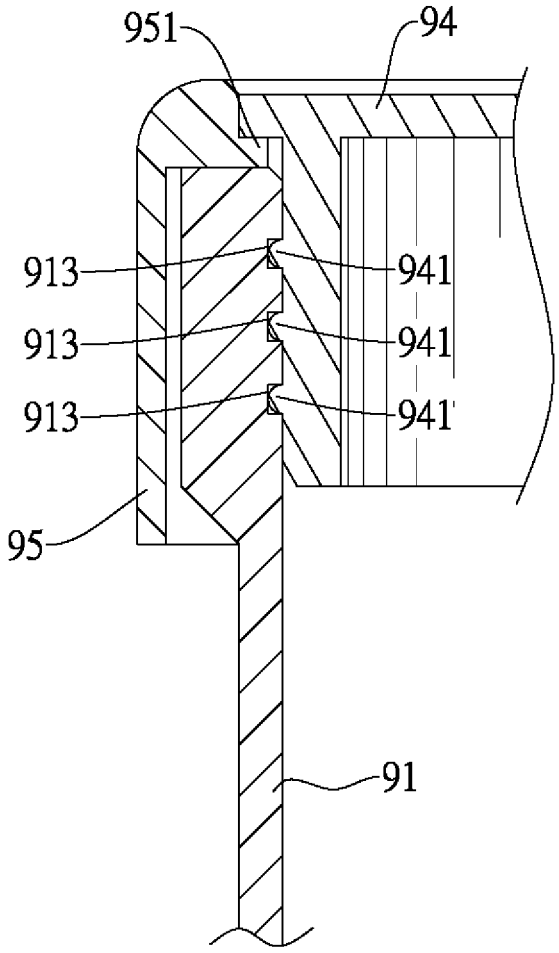
FIG.6 PRIOR ART
FIG. 6 is a partially side view in partial section of the conventional inflator in FIG. 5.

With reference to FIGS. 3 and 4, a second embodiment of an easily assembled inflator in accordance with the present invention is similar to the first embodiment as mentioned above. However, the two embodiments have some differences as follows.

In the second embodiment, the cylinder 10A has no annular groove and cylinder recess, and further has an annular stepped sidewall 15A and a cylinder protrusion 16A. The annular stepped sidewall 15A and the cylinder protrusion 16A are formed on an outside wall of the cylinder 10A. The cylinder protrusion 16A is formed adjacent to the opening 11A of the cylinder 10A.

Each cover segment 41A of the assembled seal cover 40A has no cover side flange and cover protrusion, and the cover top flange 411A is clamped between the edge of the opening 11A of the cylinder 10A and the sleeve top flanges 51A of the sleeve 50A.

The sleeve 50A further has a sleeve side flange 52A and a sleeve recess 53A. The sleeve side flange 52A is formed on the inside wall of the sleeve 50A, and abuts against the annular stepped sidewall 15A of the cylinder 10A. The sleeve recess 53A is formed on the inside wall of the sleeve 50A, and engages with the cylinder protrusion 16A of the cylinder 10A.

In the second embodiment, the cover top flanges 411A of the assembled seal cover 40A are clamped between the cylinder 10A and the sleeve 50A, and the sleeve 50A engages with the cylinder 10A by the sleeve side flange 52A abutting against the annular stepped sidewall 15A to make the sleeve 50A engage with the cylinder 10A. Thus, the sleeve 50A with the assembled seal cover 40A is mounted securely to the cylinder 10A. Besides, the engaging of the cylinder protrusion 16A and the sleeve recess 53A keeps the sleeve 50A from being rotated relative to the cylinder 10A.

The second embodiment has the same advantages, such as being easy to be assembled and being not damaged easily during the assembly.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An easily assembled inflator comprising:

a cylinder having
- an inner space;
- an opening end having an opening;
- a closed end; and
- a valve mounted through the closed end;

a piston rod mounted in the cylinder and having
- a first end;
- a second end; and
- a holder mounted on the first end;

a piston mounted on the second end of the piston rod and mounted in the cylinder;

an assembled seal cover mounted around the piston rod and having
- a set of cover segments and each cover segment having
  - a cover top flange formed around an outside wall of the cover segment, formed adjacent to a top of the cover segment and corresponding to the opening of the cylinder; and a sleeve mounted around the opening of the cylinder and having
- a sleeve top flange formed around an inside wall of the sleeve, formed adjacent to a top of the sleeve and corresponding to the cover top flanges of the assembled seal cover;

wherein the cover segments and the sleeve are separate components; the cover segments and the sleeve transversely clamp the cylinder; one of the assembled seal cover and the sleeve engages with the cylinder.

2. The easily assembled inflator as claimed in claim 1, wherein the cylinder has an annular groove formed on an inside wall of the cylinder and formed adjacent to the opening of the cylinder;

each cover segment of the assembled seal cover has a cover side flange formed on the outside wall of the cover segment and engaging with the annular groove of the cylinder to make the assembled seal cover engage with the cylinder; and the sleeve top flange of the sleeve is clamped between the edge of the opening of the cylinder and the cover top flanges of the assembled seal cover.

3. The easily assembled inflator as claimed in claim 1, wherein the cylinder has an annular stepped sidewall formed on an outside wall of the cylinder;

the sleeve has a sleeve side flange formed on the inside wall of the sleeve and abutting against the annular stepped sidewall of the cylinder to make the sleeve engage with the cylinder; and the cover top flanges of the assembled seal cover are clamped between the edge of the opening of the cylinder and the sleeve top flange of the sleeve.

4. The easily assembled inflator as claimed in claim 1, wherein the cylinder has a cylinder recess formed on an inside wall of the cylinder and formed adjacent to the opening of the cylinder; and the assembled seal cover has a cover protrusion formed on an outside wall of the assembled seal cover and engaging with the cylinder recess of the cylinder.

5. The easily assembled inflator as claimed in claim 2, wherein the cylinder has a cylinder recess formed on the inside wall of the cylinder and formed adjacent to the opening of the cylinder; and the assembled seal cover has a cover protrusion formed on an outside wall of the assembled seal cover and engaging with the cylinder recess of the cylinder.

6. The easily assembled inflator as claimed in claim 3, wherein the cylinder has a cylinder recess formed on an inside wall of the cylinder and formed adjacent to the opening of the cylinder; and the assembled seal cover has a cover protrusion formed on an outside wall of the assembled seal cover and engaging with the cylinder recess of the cylinder.

7. The easily assembled inflator as claimed in claim 1, wherein the cylinder has a cylinder protrusion formed on an outside wall of the cylinder and formed adjacent to the opening of the cylinder; and the sleeve has a sleeve recess formed on the inside wall of the sleeve and engaging with the cylinder protrusion of the cylinder.

8. The easily assembled inflator as claimed in claim 2, wherein the cylinder has a cylinder protrusion formed on an outside wall of the cylinder and formed adjacent to the opening of the cylinder; and the sleeve has a sleeve recess formed on the inside wall of the sleeve and engaging with the cylinder protrusion of the cylinder.

9. The easily assembled inflator as claimed in claim 3, wherein the cylinder has a cylinder protrusion formed on the outside wall of the cylinder and formed adjacent to the opening of the cylinder; and the sleeve has a sleeve recess formed on the inside wall of the sleeve and engaging with the cylinder protrusion of the cylinder.

* * * * *